United States Patent [19]

Maxwell

[11] 4,290,606

[45] Sep. 22, 1981

[54] NONPREDICTABLE GAME PROJECTILE

[76] Inventor: Thomas J. Maxwell, 13252 N. 47th Pl., Phoenix, Ariz. 85032

[21] Appl. No.: 91,176

[22] Filed: Nov. 5, 1979

[51] Int. Cl.[3] ..... A63F 7/40; A63F 7/24

[52] U.S. Cl. ..... 273/128 R; 273/2; 273/67 A; 273/68; 273/85 R; 273/87.2; 273/129 K; 273/129 L

[58] Field of Search ..... 273/85 R, 2, 128, 129, 273/68, 167, 168, 67 A, 87; D21/7, 9, 11, 51, 210, 211, 214, 217, 218

[56] References Cited

U.S. PATENT DOCUMENTS

| | | | |
|---|---|---|---|
| D. 201,250 | 6/1965 | Martinez | 273/167 D X |
| D. 222,889 | 1/1972 | Dziurgot | 273/167 J X |
| 797,675 | 8/1905 | Fletcher | 273/128 R X |
| 1,612,708 | 12/1926 | Dillman | 273/129 S X |
| 1,846,412 | 2/1932 | Weinberg | 273/129 W |
| 2,577,189 | 12/1951 | Hammett | 273/129 L |
| 2,727,744 | 12/1955 | Watson | 273/128 R |
| 3,467,386 | 9/1969 | Smith | 273/128 R X |
| 3,489,412 | 1/1970 | Franck et al. | 273/67 A |
| 3,554,549 | 1/1971 | Grabowski | 273/129 L X |
| 3,608,211 | 9/1971 | Carr | 273/129 S X |
| 3,889,945 | 6/1975 | Ellis | 273/128 R X |

FOREIGN PATENT DOCUMENTS

| | | | |
|---|---|---|---|
| 123997 | 4/1947 | Australia | 273/85 R |
| 2749610 | 5/1979 | Fed. Rep. of Germany | 273/128 CS |
| 886683 | 7/1943 | France | 273/85 R |
| 19754 | of 1899 | United Kingdom | 273/85 R |
| 10497 | of 1907 | United Kingdom | 273/168 |

*Primary Examiner*—Paul E. Shapiro
*Attorney, Agent, or Firm*—Don J. Flickinger

[57] ABSTRACT

A game projectile is configured as a polyhedron rather than being spherical or cylindrical in shape. The projectile is independently supported above the low friction base by which it moves across the playing surface. Provision may be made to permit the polyhedron to rotate about its independent support. A further embodiment provides that the location of the point of support of said polyhedral projectile may be varied to assure that the support axis does not pass through the mass center of the projectile. This disclosure teaches the use of impelling instruments having striking surfaces which are configured such that the contact of said striking surfaces with said polyhedron will tend to project the polyhedron across the playing surface on an imprecisely determinable path. The combined effect of polyhedral shape, mounting arrangement, and peculiarity of configuration of the striking surface of the impelling instrumentation greatly increase the element of chance as it affects the outcome of the game, while the player's inherent skill is minimized. The game thus becomes one in which players of all levels of skill and sophistication may join together to play and enjoy.

6 Claims, 12 Drawing Figures

NONPREDICTABLE GAME PROJECTILE

BACKGROUND

1. Field of the Invention

The invention relates to the field of games. More particularly, the invention relates to games in which a projectile is impelled over a playing surface as in playing miniature golf, hockey, and pool or billiards.

2. Prior Art

A pre-examination search was performed prior to the preparation of the accompanying patent application. The following represents a listing of the prior art which was evaluated prior to deciding to go forward with the subject application:

Design Patents—U.S. Pat. Nos. Des. 204,890 and 219,460: These represent ornamental designs for golf putters.

Utility Patents—U.S. Pat. Nos. 3,039,776 and 3,194,564: Each represent a golf club having means thereon whose purpose is to improve the golfer's swing and to increase the accuracy with which the golf ball is driven away from the striking face of the club.

Utility Patents—U.S. Pat. No. 711,979 issued to Knight; U.S. Pat. No. 1,548,068 issued to Sullivan; and U.S. Pat. No. 3,413,755 issued to Mishler are all directed to games and game apparatus. The '068 and '755 patents both utilize hand manipulated impelling instruments. The '979 patent moves the game pieces in the same fashion as is done in a game of tiddly winks.

A game projectile or puck is disclosed in each of U.S. Pat. Nos. 2,511,147 issued to Braun; 2,623,748 issued to Lucero; 3,784,204 issued to Felber; and 2,727,744 issued to Watson. All of these projectiles comprise right sections of cylindrical configurations. The '147, '204 and '744 patents provide ball thrust bearings for moving the projectile across the playing surface. The '748 projectile of Lucero moves across the playing surface on wear resistent patches.

None of the prior art evaluated disclosed a polyhedral projectile having a striking surface comprised of various planes and vertices coupled with support means all of which act in combination to confound the players ability to direct the projectile along a desired path.

Various games exist wherein the player impells a projectile across a playing surface in a prescribed manner and deriving a game score for properly placing the projectile at specified locations on the playing surface. Such games are represented by the familiar miniature golf courses in which a golf ball is impelled along the playing surface and directed to various recesses along the pathway defined by the playing surface. Hockey represents another such sport. Here a puck, a right section of a circular cylinder, is impelled across a playing surface with the intent of placing the puck within a goal defended by an opponent player. Of the same genre are the pool or billiard games in which a pool ball is projected across the surface of a pool or billiard table with the specific intent of placing the ball at its desired location either directly or indirectly by causing the projectile to rebound from the playing surface boundaries or from other game projectiles on the playing surface.

All such games are characterized by hand wielded implements used to strike the projectile and impell it across the playing surface. The projectiles themselves are all configured so as to have spherical or cylindrical shapes such that when struck by the impelling instrumentation, for example, the face of the golf club, hockey stick, or the pool cue, the force of the impelling blow is directed along a radius through the center of the playing projectile. The purpose of directing the impelling force through the center of the playing projectile is to assure a true flight path across the playing surface in the direction intended by the player. Thus, as the skill of the player increases, the projectile is impelled to the desired location with increasing accuracy, role of chance being minimized as the player continues the game.

Where skill and practice determine the outcome of the game and the effects of chance are minimized, new players find it difficult to learn the game unless they are able to find a more skillful player who is predisposed to teach a novice or until they locate an instructor whom they may hire to teach them the fine points of the game. The sight of a skillful player searching for a "worthy" opponent becomes a familiar one and his avoidance of the novice player is readily apparent.

It is therefore an object of the present invention to emphasize the element of chance and to reduce the effect of players skill and practice so as to provide a game which may by played enjoyably by all players regardless of their age, manual dexterity, or familiarity with the game.

It is a further object of the invention to provide a playing projectile which will not move across the playing surface in the precise path planned by the player when he imparts his impelling stroke to the projectile.

It is a most specific object of the invention to provide a game projectile which is a polyhedron independently supported above the means by which it moves across the playing surface.

It is an even more specific objective of the invention that such a polyhedral projectile be free to rotate about said independent support.

SUMMARY OF THE INVENTION

The invention comprises a game projectile which is configured as a polyhedron rather than being spherical or cylindrical in shape. The projectile is independently supported above the means by which it moves across the playing surface. Provision may be made to permit the polyhedron to rotate about its independent support. A further embodiment provides that the location of the point of support of said polyhedral projectile may be varied to assure that the support axis does not pass through the mass center of the projectile. In the embodiment disclosed herein, the projectile is a polyhedron independently supported upon a vertical shaft which shaft in turn is coupled to a ball thrust bearing, which ball thrust bearing provides a low friction means for moving the independently supported polyhedron across the playing surface. Additional bearings coupling, said polyhedron to said vertical shaft, permit the polyhedron to rotate independently about said shaft. Provision for mounting said shaft at various sites within said polyhedron assures that there will be one such mounting site which will displace said shaft from the center of gravity of said polyhedron. The configuration of the projectile and the method by which it is mounted on the low friction thrust bearings make it most difficult to determine the path the projectile will taken when it is impelled across the surface of the playing field of the game for which the projectile is used. To further increase the nondeterminability of the flight path of the projectile across the surface of the playing field, this disclosure teaches the use of impelling instruments having striking surfaces which are configured such that the contact of said striking surfaces with said polyhedron will tend to project the polyhedron across the playing surface on an imprecisely determinable path. The combined effect of polyhedral shape, mounting arrangement, and pecularity of configuration of the striking surface of the impelling instrumentation greatly increase the element of chance as it affects the outcome of the game, while the player's inherent skill is minimized. The game thus becomes one in which players of all levels of skill and sophistication may join together to play and enjoy.

DETAILED DESCRIPTION OF THE INVENTION

Figure 1:
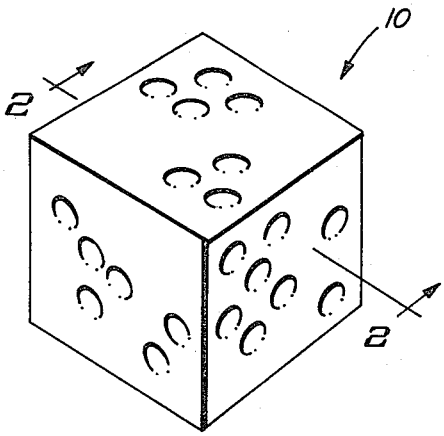
FIG. 1 illustrates a polyhedral projectile to be used as a playing piece in the manner herein described. The illustration is conceived as a cubical golf "ball", its square faces leading into the associated game being denoted as SQOLF.

The invention, in its essence, comprises a playing piece which is projected across the surface of a playing field by an impelling instrument. The playing piece, in accordance with the teachings herein disclosed, is designed so that its path of motion across the playing surface will be most difficult to predict. Striking surfaces of impelling instruments used with the projectile are configured so as to compound the unpredictability of the projectile's motion. FIG. 1 illustrates the concept of a polyhedral projectile such as might be used in a game denoted SQOLF under rules similar to those of the game of miniature golf. Because the striking surface of projectile 10 is comprised of planes and vertices, the force imposed by the impelling instrument will not predictably pass through the center of gravity of projectile 10. The cubic form of projectile 10, shown in FIG. 1, is meant for purposes of illustration only and is not intended to limit the shape of the polyhedron used with the particular projectile developed in accordance with the teachings herein.

Figure 2:
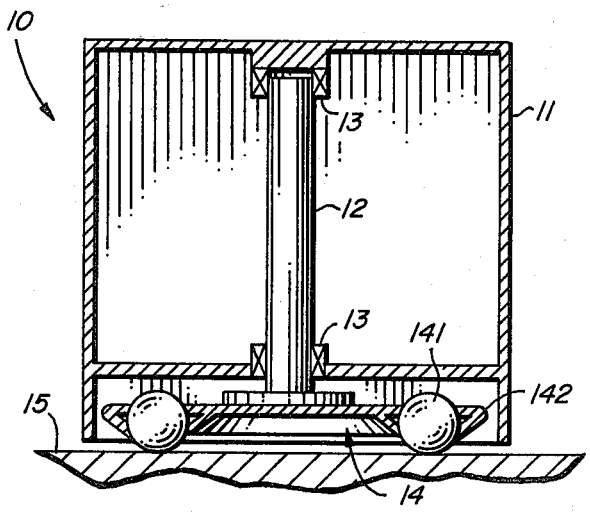
FIG. 2 is a cross-sectional view of the polyhedral projection of FIG. 1 showing the polyhedron to be independently supported upon a vertical shaft which in turn is supported by ball thrust bearings which provide the means for moving the polyhedral projectile across the surface of the playing field in a low friction manner.
Figure 5:
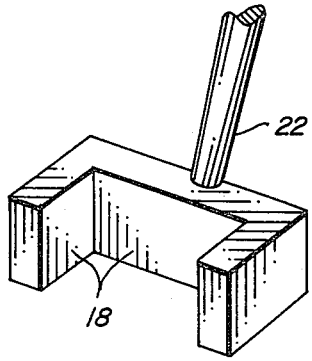
FIGS. 4–8 depict various embodiments of the impelling instrumentation used to project the polyhedral projectile across its playing surface. The striking surfaces of these impelling instruments are configured so as to make the path of motion of the projectile minimally predictable.
Figure 3:
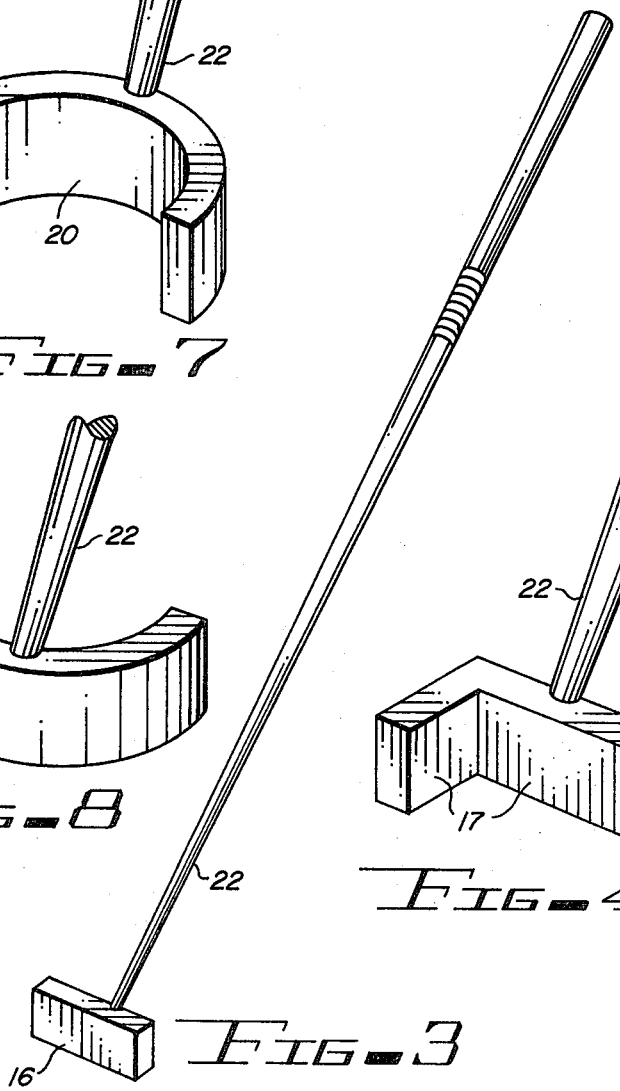
FIG. 3 illustrates an impelling instrument for projecting the polyhedral projectile across the playing surface. The impelling instrumentation of FIG. 3 is in the general configuration of a conventional golf club.

Some of the details of a presently preferred embodiment of the invention are shown in the drawing of FIG. 2. This drawing is a cross-section of the polyhedral projectile 10 of FIG. 1. Walls 11 define the polyhedral enclosure desired. Polyhedral 11 is independently supported by vertical shaft 12. Bearings 13 may be provided so as to couple polyhedron 11 to shaft 12 in manner which permits polyhedron 11 to rotate about shaft 12. Shaft 12 is supported upon a low friction means for moving polyhedral projectile 10 across the playing surface. In FIG. 2 this low friction moving means is illustrated as thrust bearing 14 which is comprised of ball bearings 141 and ball thrust retainer 142. When an impelling force is applied to polyhedron projectile 10, thrust bearing 14 provides a low friction means for moving polyhedron 11 across playing surface 15. As it moves, polyhedron 11 will tend to rotate about its support shaft 12. Thrust bearing 14 will move polyhedral projectile 10 in any direction in which it is impelled by the impelling force. The playing surface and vertices of polyhedron 11, combined with the rotation effect of polyhedron 11 about shaft 12, make the path of motion of projectile 10 more difficult to predict. In playing a game of SQOLF, an impelling instrument similar to a golf club may be used, see FIG. 3. The striking face 16 of the impelling instrument of FIG. 3, unlike the conventional golf club, is designed to inhibit lifting of polyhedral projectile 10 from the surface of the playing field. To this end, it may be noted, that the center of gravity of polyhedral projectile 10 should be maintained below so as to prevent projectile 10 from lifting from the surface of playing field 15 or from toppling. Striking surface 16 of the impelling instrument of FIG. 3 is essentially planar and does nothing, of itself, to discourage accurately predicting the path which projectile 10 will take across surface 15. To enhance the nonpredictability of motion of polyhedral projectile 10, impelling instruments having striking surfaces deliberately configured so as to tend to project the polyhedron 11 across playing surface 15 on an imprecisely determinable path are illustrated as striking surfaces 17 thru 21 in FIGS. 4 thru 8, respectively.

Figure 7:
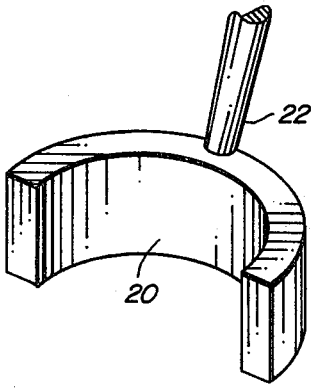
Figure 6:
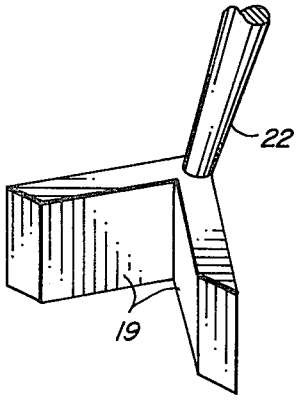
Figure 8:
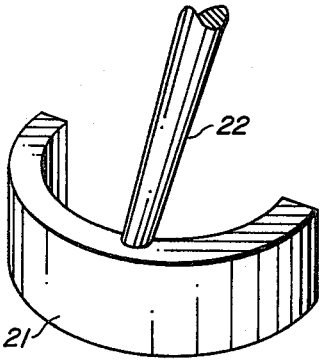
Figure 4:
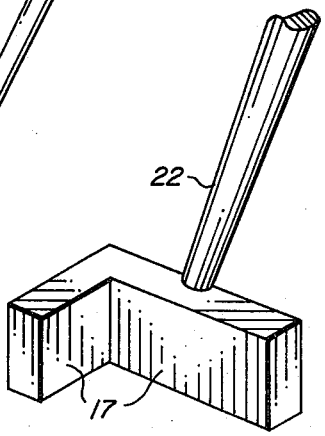

Each striking surface, 16–21, is generally upright with respect to playing surface 15. In the embodiment of FIG. 3, striking surface 16 is in the form of a single plane. Striking surface 17, viewed in FIG. 4, comprises a pair of planes angularly disposed in a generally L-shaped configuration. Similarly, striking surface 19, illustrated in FIG. 6, includes two planes which intersect to form a V-shaped element. The three planes of striking surface 18, seen in FIG. 5, form a squared U configuration. FIG. 7 shows a concave striking surface 20, while a convex striking surface 21 is seen in FIG. 8.

All of the impelling instruments of FIGS. 3 thru 8 are provided with a shaft 22 for manipulating the associated striking surfaces so as to bring them into contact with polyhedral projectile 10 so as to project polyhedron 11 across playing surface 15.

Figure 9:
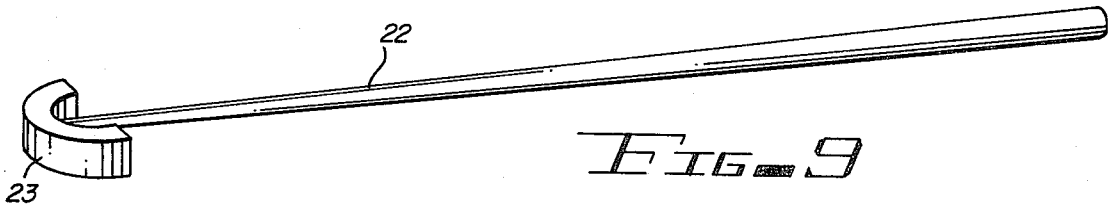
FIG. 9 depicts an alternate embodiment of an impelling instrument for use when the polyhedral projectile is used in a game similar to that of pool or billiards. The traditional cue is modified in that its striking surface is configured, like those in FIGS. 4–8, so as to impart a motion to the polyhedral projectile which is minimally predictable.

For a game such as SQOOL or SQILLIARDS (analogous to POOL or BILLIARDS), an impelling instrument such as illustrated in FIG. 9 would be utilized. Shaft 22 would be manipulated in much the same manner as a pool cue whereas the striking surface 23 would be peculiarly configured so as to confound prediction of the path of motion of polyhedral projectile 10 across surface 15 of the field of play.

Figure 11:
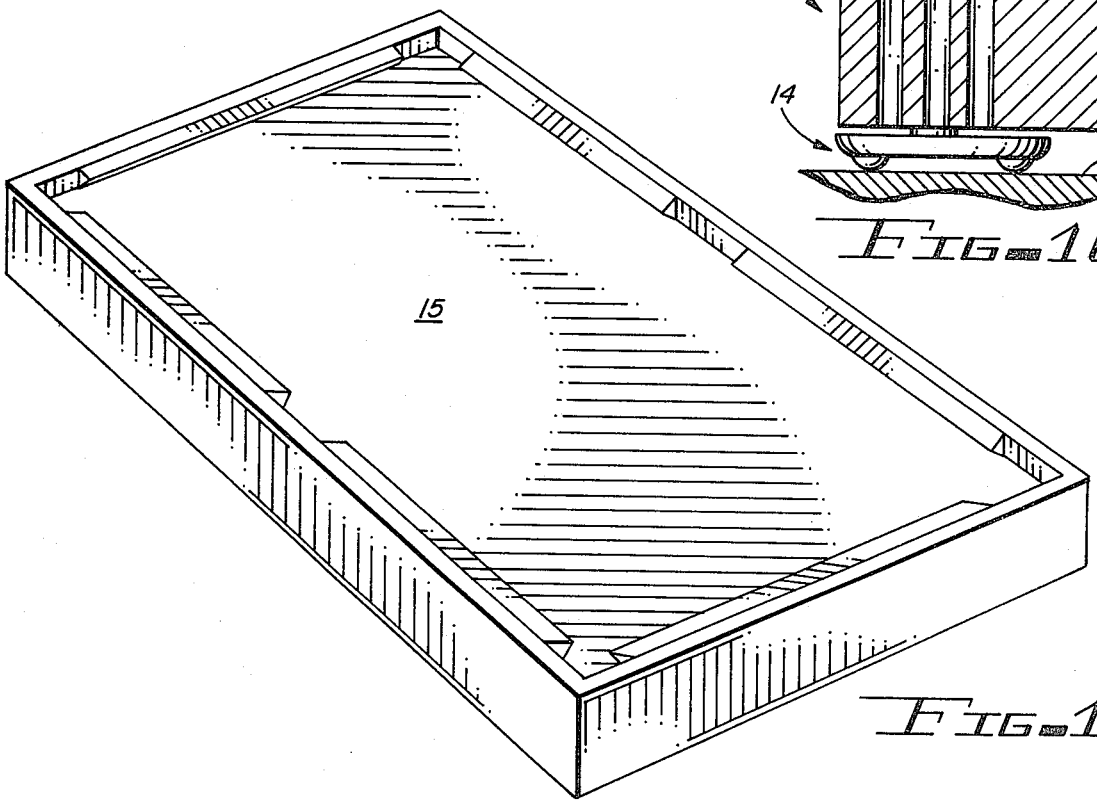
FIG. 11 illustrates a playing field which may be utilized with the polyhedral projectile disclosed here, showing side deflection bumpers at the boundary of the playing field and target positions into which the player will hopefully place one of the polyhedral game pieces so as to increase his game score.
Figure 12:
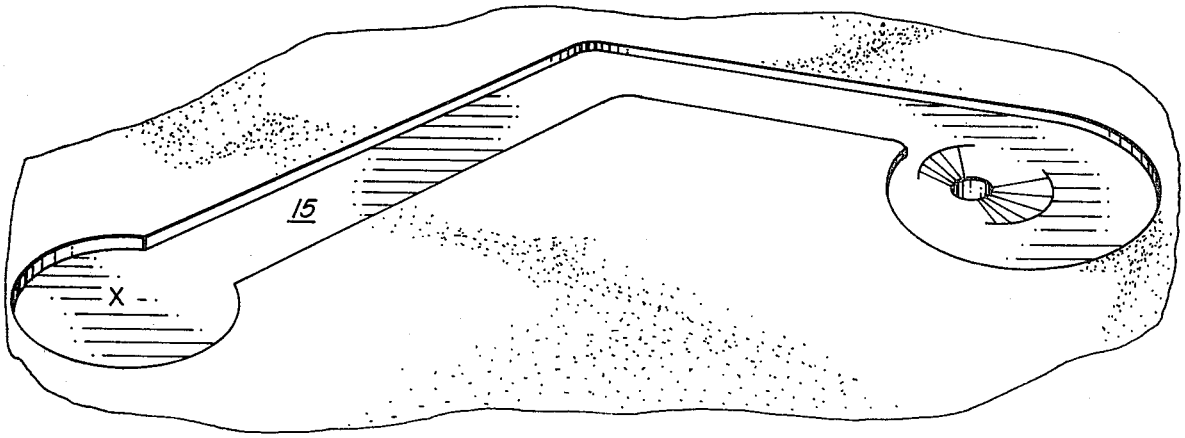
FIG. 12 illustrates a playing field surface which might be used in playing a game similar to miniature golf and which game may be denoted SQOLF. The object of the game, as in miniature golf, will be to place the polyhedral projectile within a recess in the surface of the playing field.

The playing surface 15 for a game of SQOOL or SQILLIARDS is illustrated in FIG. 11, whereas the analogos playing surface 15 for a game of SQOLF is suggested by the drawing of FIG. 12.

Polyhedral projectile 10 may also be adapted for the game of SQOCKY, a game reminiscent in its playing rules to the game of HOCKEY. Because of the low friction movement provided by thrust bearing 14, the game of SQOCKY may be played on any hard smooth surface and is not limited to playing on ice.

Figure 10:
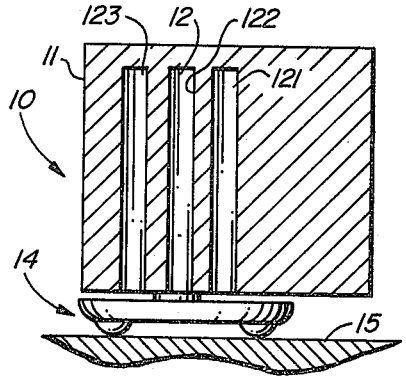
FIG. 10 is an alternate embodiment of the polyhedral projectile of FIG. 1 presented in cross-section. The drawing provides means thereby the mounting shaft which supports the polyhedron may be relocated so as to ensure the shaft is displaced from the center of gravity of said polyhedron. Any motion imparted to said projectile will thus have a tendency to cause the projectile to rotate as it moves across the surface of the playing field.

To further confound the predictability of the path of motion of polyhedral projectile 10 across the playing surface 15, provision may be made to move the point of support of polyhedron 11 so as to displace it a desired distance away from the center of mass of polyhedron 11. Such provision is illustrated in FIG. 10 wherein polyhedron 11 is provided with a plurality of spare support bores 121, 122 and 123. The use of a bore to support chair 12 is shown for illustrative puposes only and is not meant to limit the manner in which chair 12 may be supported. As suggested in FIG. 10, a bore 121 may be provided with passes through the center of gravity of polyhedron 11. This will least confound the predictability of the path of motion of projectile 10 across surface 15. By re-locating shaft 12 to bore 122, as illustrated in FIG. 10, the center of mass of polyhedron 11 is displaced to the right of the illustration and the resultant mass unbalance will tend to create an erratic path of motion of projectile 10 across surface 15. Displacing shaft 12 to bore 123 would further increase the tendency of projectile 11 to follow an erratic path across surface 15.

It is recognized that using the teachings disclosed herein to play games such as SQOLF, SQOOL or SQILLIARDS, and SQOCKY require the participants to comply nominally with the rules of the parent games, that is: miniature golf, pool or billiards, and hockey. However, local rules may be derived to further enhance the role of chance in the outcome-determination of the game. For example, the player himself may choose the impelling instrument with its peculiarly shaped striking surface. Alternately, the player's opponent may select the striking implement which will be utilized by that opponent as he takes his turn. Various embodiments for assembly of the striking instruments may be derived so as to cause variation in the angle at which the shaft and the striking face are joined or even the stability with which the striking face is fastened to the shaft. Anything may be done which enhances the outcome-determining role of chance and reduces the effect of the player's inherent skill. The nonpredictability of outcome will challenge the skillful while that very nonpredictability will encourage those who lack skill in the conventional games upon which the present play is predicated.

Those skilled in the art will recognize that various embodiments of the invention may be derived with departing from the spirit and scope of that which is disclosed and claimed herein.

Having defined my invention in such clear and concise terms in the specification and in the drawings accompanying it that those skilled in the art may easily and simply practice the invention,

What is claimed:

1. Apparatus in which a movable piece is projected across a playing surface comprising
   a polyhedral projectile; and
   low friction means for moving said polyhedral projectile across said playing surface coupled to said polyhedral projectile such that a vertical axis of symmetry of said low friction moving means is displaced from the mass center of said polyhedral projectile.

2. Apparatus for a game in which a movable piece is projected across a playing surface comprising:
   an independently supported polyhedron;
   low friction means for moving said independently supported polyhedron across a playing surface; and
   means for rotating said polyhedron independent of said low friction moving means.

3. The apparatus of claim 2 wherein said polyhedron is independently supported on a shaft and said means for rotating said polyhedron comprises bearings coupling said shaft and said polyhedron.

4. Apparatus for a game in which a movable piece is projected across a playing surface comprising:
   an independently supported polyhedron;
   low friction means for moving said independently supported polyhedron across a playing surface; and
   means for changing the location at which said polyhedron is independently supported.

5. The apparatus of claim 4 wherein said independently supported polyhedron further comprises means for rotating said polyhedron independent of said low friction moving means.

6. The apparatus of claim 5 wherein said polyhedron is independently supported on a shaft and said means for rotating said polyhedron comprises bearings coupling said shaft and said polyhedron.

* * * * *